US007520792B2

(12) United States Patent
Yen

(10) Patent No.: US 7,520,792 B2
(45) Date of Patent: Apr. 21, 2009

(54) WHEEL ASSEMBLY FOR A MODEL AIRPLANE

(75) Inventor: Li-Hua Yen, Taichung Hsien (TW)

(73) Assignee: EPF Hobby Co., Ltd. (TW)

( * ) Notice: Subject to any disclaimer, the term of this patent is extended or adjusted under 35 U.S.C. 154(b) by 212 days.

(21) Appl. No.: 11/554,071

(22) Filed: Oct. 30, 2006

(65) Prior Publication Data

US 2008/0102728 A1 May 1, 2008

(51) Int. Cl.
*A63H 27/00* (2006.01)

(52) U.S. Cl. ..... 446/55; 244/102 R

(58) Field of Classification Search ..... 446/55; 244/102 R, 102 A, 103 S, 100 R
See application file for complete search history.

(56) References Cited

U.S. PATENT DOCUMENTS 2,148,972 A * 2/1939 Waseige ..... 244/102 R
2,565,007 A * 8/1951 Van Zelm et al. ..... 244/102 R
2,578,897 A * 12/1951 Oliver ..... 244/50
2,755,041 A * 7/1956 Lewis ..... 244/102 R
2,801,817 A * 8/1957 Brader ..... 244/102 R
3,088,699 A * 5/1963 Larson ..... 244/102 R
3,132,829 A * 5/1964 Bochman, Jr. ..... 244/102 R
4,444,071 A * 4/1984 Guichard ..... 74/427

* cited by examiner

*Primary Examiner*—Rob Swiatek
*Assistant Examiner*—Michael Kreiner
(74) *Attorney, Agent, or Firm*—Sheridan Ross P.C.

(57) ABSTRACT

A wheel assembly for a model airplane includes a motor, a drive gear unit, a linkage, and a wheel unit. The drive gear unit includes a driven gear meshing with a driving gear connected fixedly to a spindle of the motor, and an output gear driven indirectly by the driven gear. The linkage includes a swing rod connected fixedly to the output gear, and a link connected pivotally to the swing rod. The wheel unit has a pivot end connected pivotally to an airplane body, a wheel-mounting end mounted with at least one wheel, and an intermediate portion connected pivotally to the link. The motor is operable to activate the drive gear unit so as to rotate the wheel unit between a generally horizontal idle position, and an upright landing position.

3 Claims, 10 Drawing Sheets

WHEEL ASSEMBLY FOR A MODEL AIRPLANE

BACKGROUND OF THE INVENTION

1. Field of the Invention

This invention relates to a model toy, and more particularly to a wheel assembly for a model airplane.

2. Description of the Related Art

Referring to FIGS. 1 and 2, a conventional wheel assembly for a model airplane includes a housing unit 1, a pneumatic cylinder 2 disposed pivotally on the housing unit 1, and a wheel unit 3 disposed pivotally on the housing 1 and driven by the pneumatic cylinder 2. The housing unit 1 includes a housing body 101 and two aligned lugs 102 formed integrally with the housing body 101. The housing body 101 has two aligned side plates 103, two aligned pivot holes 104 formed respectively through lower end portions of the side plates 103, and two aligned guide slots 405 formed respectively through the side plates 103 and located respectively above the pivot holes 104. Each of the guide slots 405 has a curved section 405' and two positioning sections 405" extending respectively and upwardly from two opposite ends of the curved section 405'. The pneumatic cylinder 2 has a cylinder body 201 disposed pivotally between the lugs 102, a piston rod 202 connected movably to the cylinder body 201, and a driving rod 203 connected fixedly to and perpendicular to an end of the piston rod 202. The driving rod 203 extends through the guide slots 405. The wheel unit 3 includes a stop block 301 disposed within the housing body 101, a swing rod 302 having one end connected fixedly to the stop block 301, and two wheels 303 disposed on the other end of the swing rod 302. The stop block 301 has an integral pivot pin 301' extending through the pivot holes 104, and a retaining slot 301". The driving rod 203 is received slidably within the retaining slot 301".

The piston rod 202 is movable relative to the cylinder body 201 between an extended position shown in FIG. 1 and a retracted position shown in FIG. 2. When the piston rod 202 is disposed in the extended position, the wheel unit 3 is disposed in an upright landing position. When the piston rod 202 is disposed in the retracted position, the wheel unit 3 is disposed in a generally horizontal idle position.

The use of the pneumatic cylinder 2 raises an instability issue. Inparticular, since the piston rod 202 moves relative to the cylinder body 201 at a high speed, rebounding of the driving rod 203 occurs at the ends of each of the curved sections 405' during movement of the driving rod 203 within the guide slots 405. Thus, it is difficult for the driving rod 203 to move fully into the positioning sections 405". That is, the wheel unit 30 cannot be locked effectively at the idle position and the landing position.

SUMMARY OF THE INVENTION

The object of this invention is to provide a wheel assembly for a model airplane that includes a wheel unit, which can be locked effectively at a landing position and an idle position.

According to this invention, there is provided a wheel assembly for a model airplane. The model airplane has an airplane body. The wheel assembly is adapted to be mounted to the airplane body and comprises:

a driving mechanism including a motor and a drive gear unit driven by the motor, the motor including a spindle and a driving gear disposed fixedly on the spindle, the drive gear unit including a driven gear meshing with the driving gear, and an output gear driven indirectly by the driven gear;

a linkage including a swing rod connected fixedly to the output gear at one end thereof, and a link having one end connected pivotally to the other end of the swing rod; and a wheel unit having a pivot end adapted to be connected pivotally to the airplane body, a wheel-mounting end opposite to the pivot end and mounted with at least one wheel, and an intermediate portion interconnecting the pivot end and the wheel-mounting end and connected pivotally to the other end of the link;

wherein the motor is operable to activate the drive gear unit so as to rotate the wheel unit between a generally horizontal idle position, where at least a portion of the wheel is concealed within the airplane body, and an upright landing position, where the wheel is spaced apart from the airplane body.

By cooperation between the linkage and the drive gear unit, the wheel unit can be locked effectively at the landing position and the idle position.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
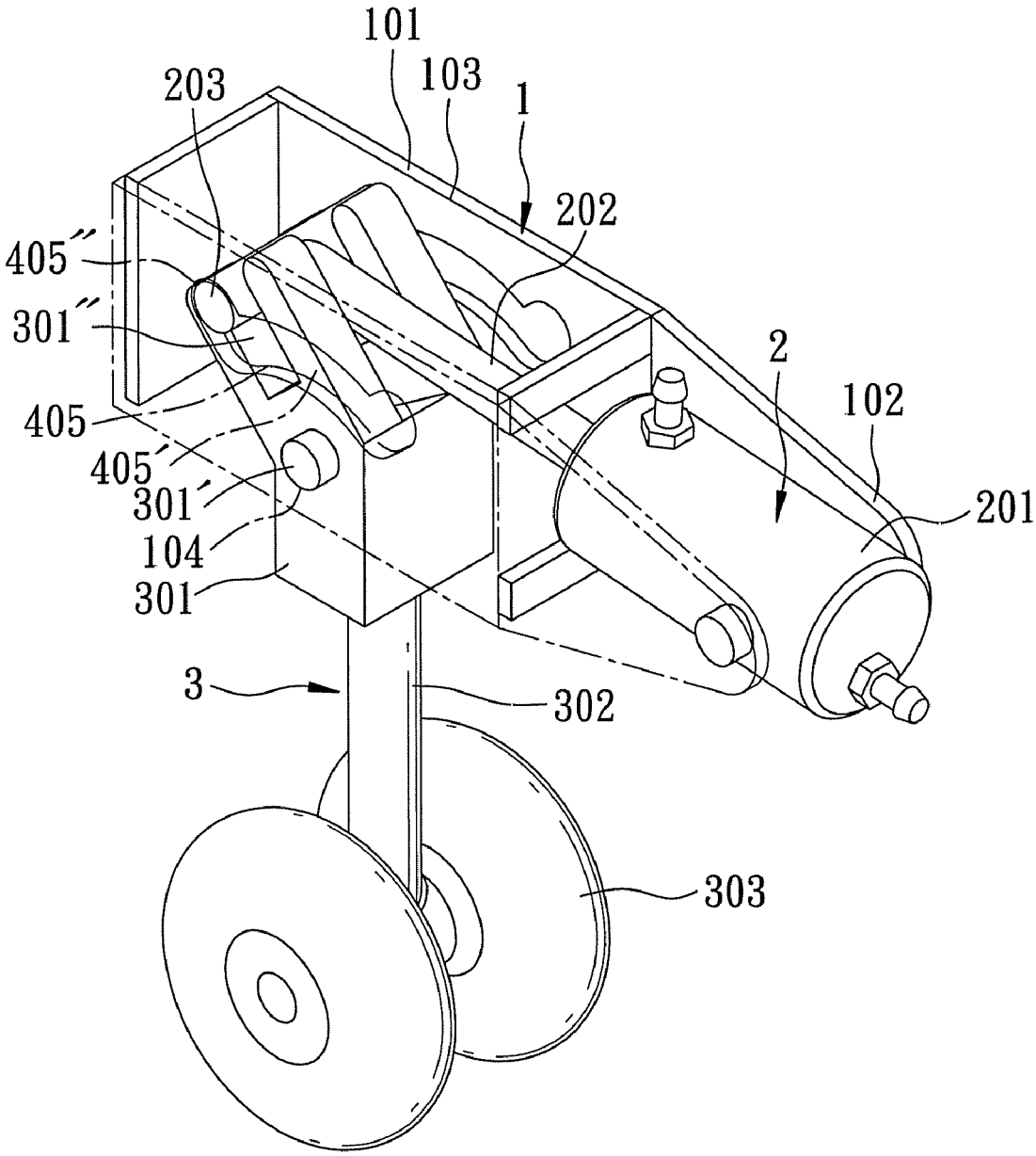
FIG. 1 PRIOR ART
FIG. 1 is a perspective view of a conventional wheel assembly for a model airplane when a wheel unit is disposed in a landing position.
Figure 2:
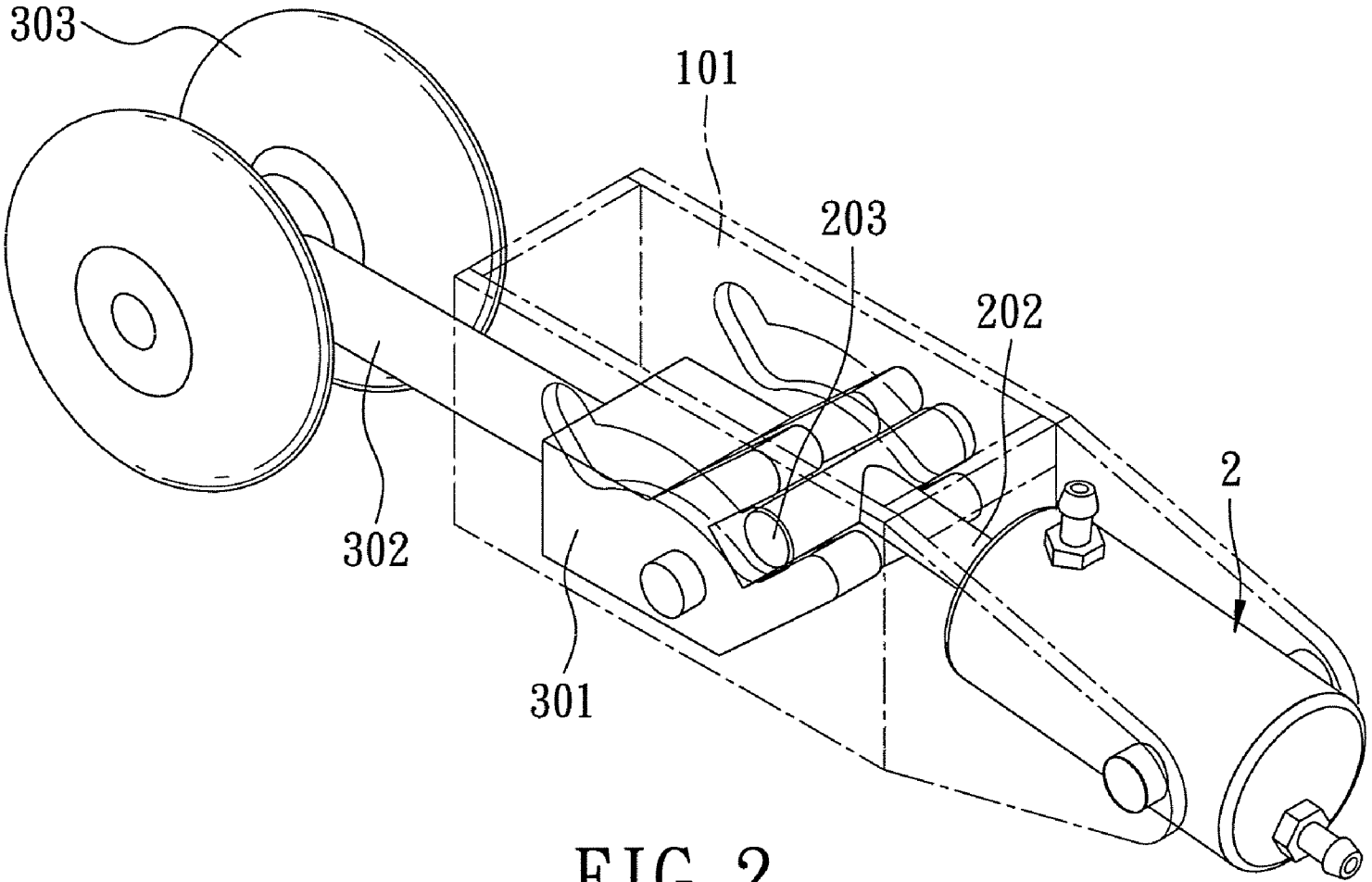
FIG. 2 PRIOR ART
FIG. 2 is a perspective view of the conventional wheel assembly when the wheel unit is disposed in an idle position.
Figure 3:
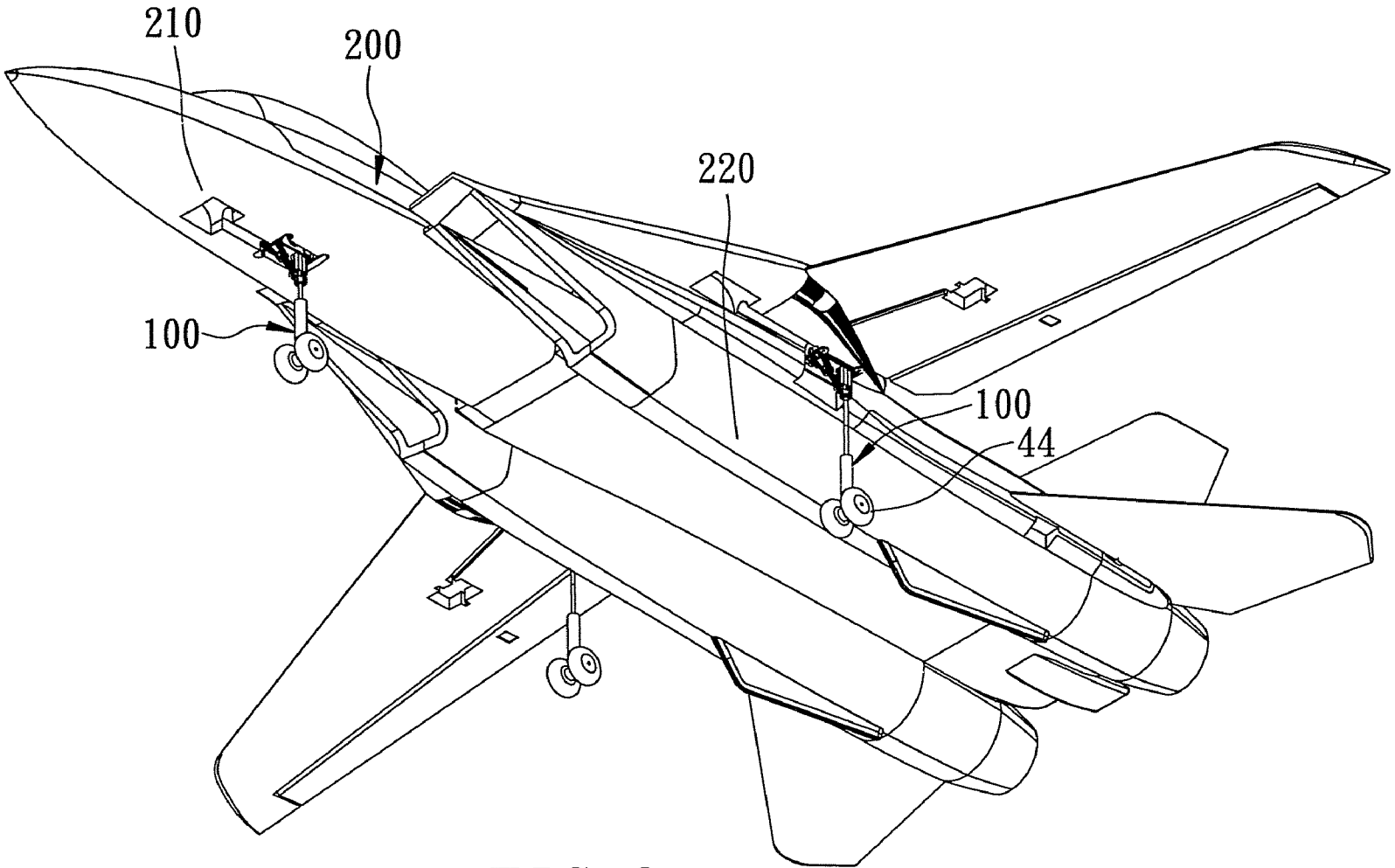
FIG. 3 is a perspective view of a model airplane equipped with the preferred embodiments of three wheel assemblies according to this invention when a wheel unit of each of the wheel assemblies is disposed in a landing position.

Referring to FIG. 3, the preferred embodiments of three wheel assemblies 100 according to this invention are mounted respectively on a nose portion 210, as well as on the left and right sides of a belly portion 220 of an airplane body 200 of a model airplane. One of the wheel assemblies 100 will be described hereinafter.

Figure 4:
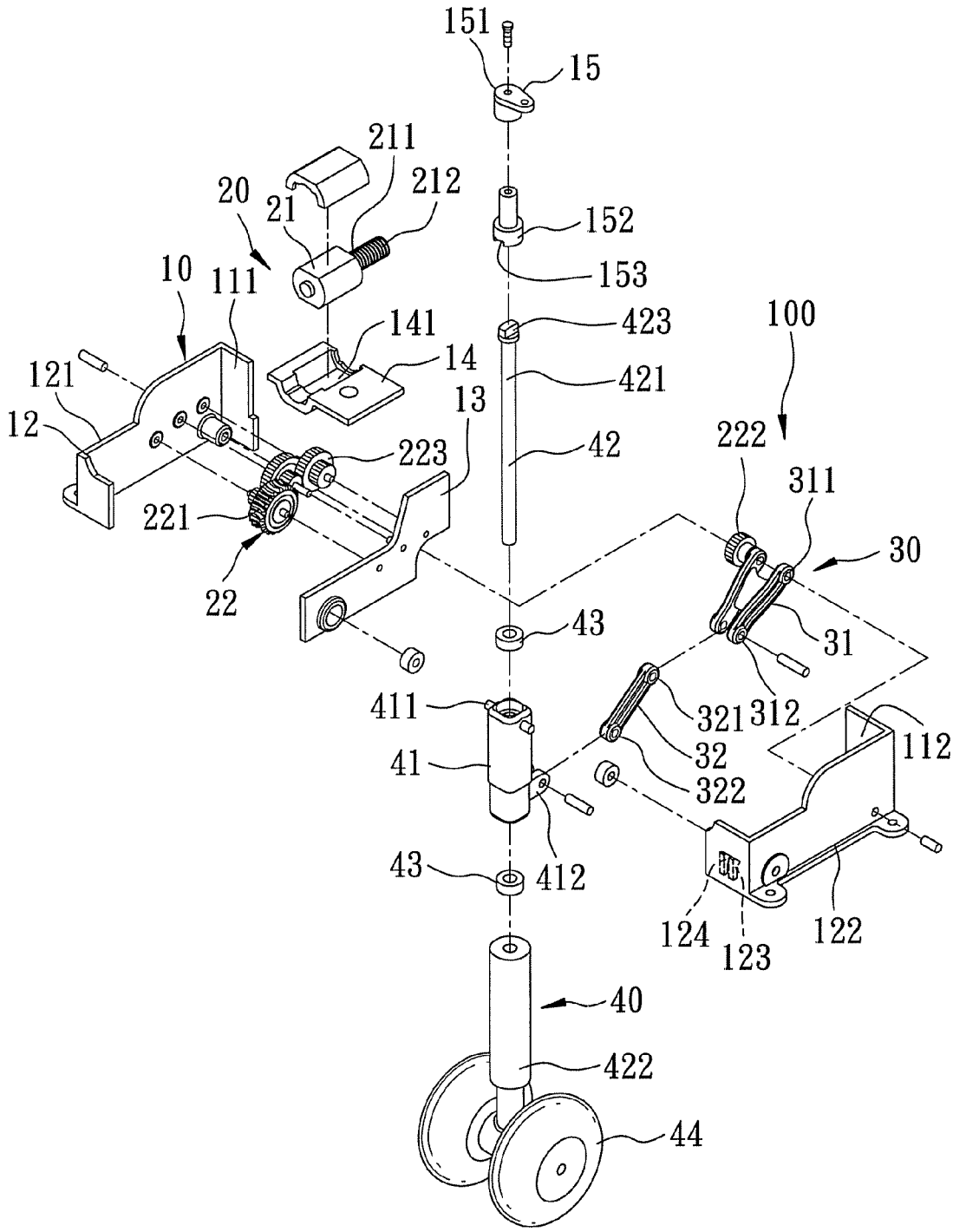
FIG. 4 is an exploded perspective view of the preferred embodiment.
Figure 5:
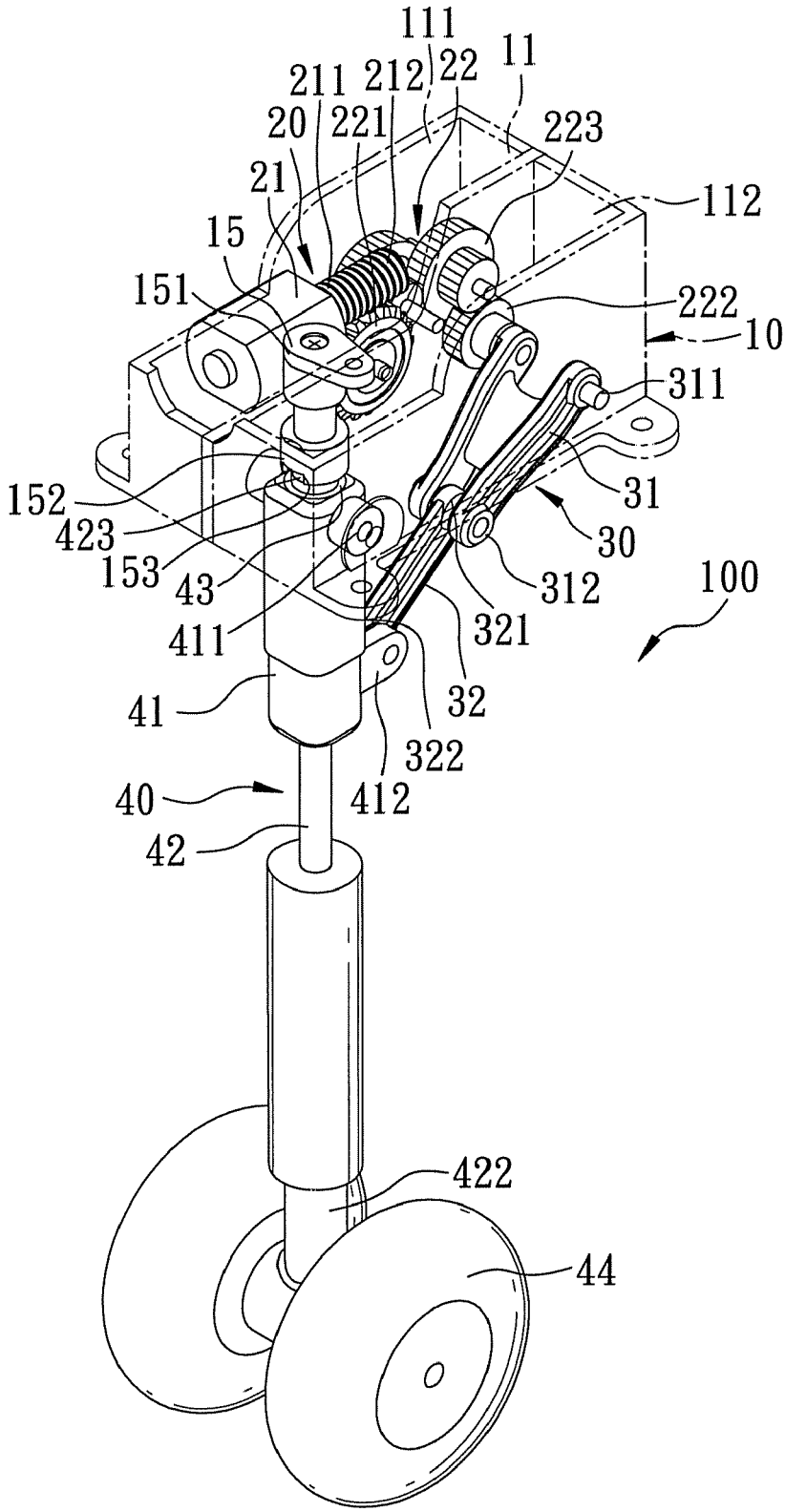
FIG. 5 is an assembled perspective view of the preferred embodiment when the wheel unit is disposed in the landing position.

With further reference to FIGS. 4 and 5, the wheel assembly 100 includes a housing unit 10, a driving mechanism 20, a linkage unit 30 driven by the driving mechanism 20, and a wheel unit 40 rotated by the linkage unit 30. The driving mechanism 20 and the linkage unit 30 are disposed within the housing unit 10.

Figure 6:
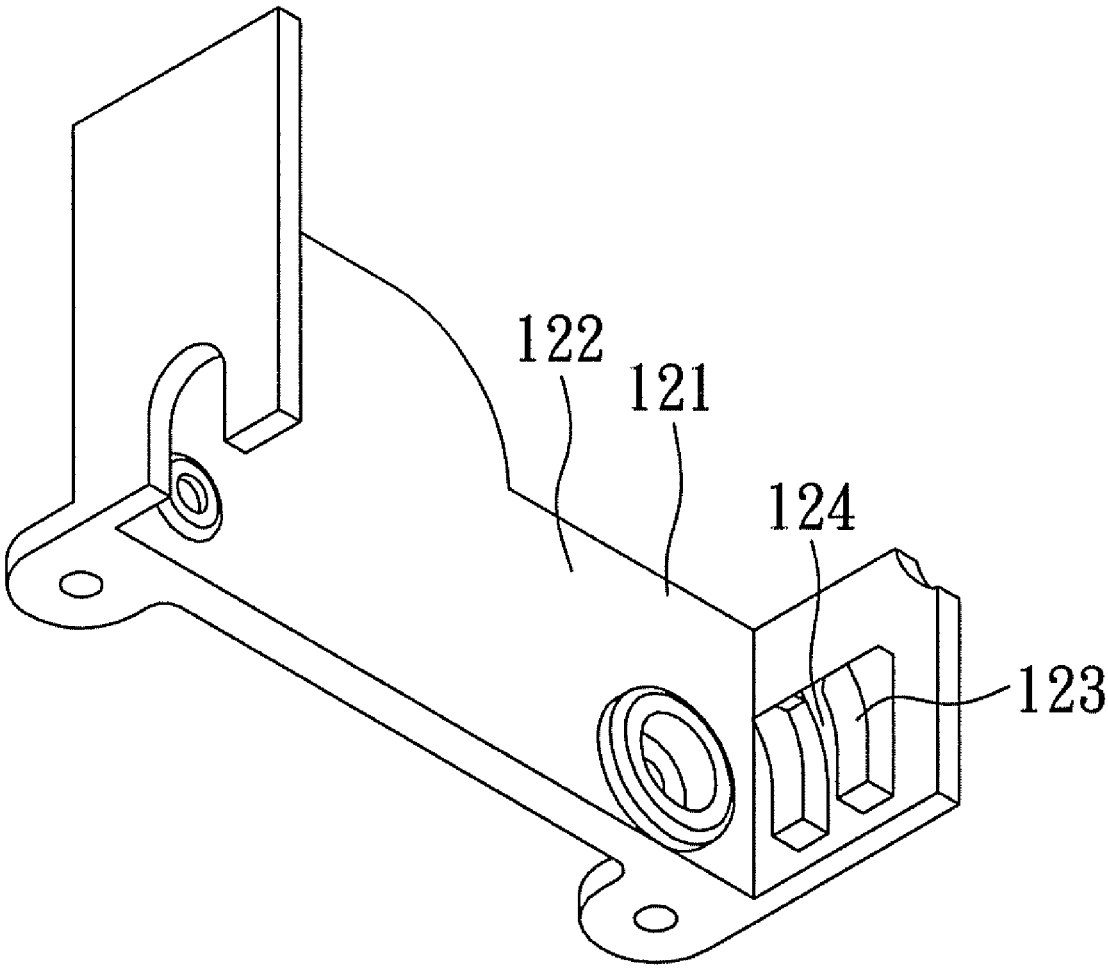
FIG. 6 is a perspective view of a second housing member of a housing unit of the preferred embodiment.

The housing unit 10 is rectangular, and includes a surrounding wall 12 connected fixedly to the airplane body 200 and defining an accommodating chamber 11, a partition 13 disposed within the accommodating chamber 11 so as to divide the accommodating chamber 11 into first and second spaces 111, 112, a top plate 14 connected fixedly to a top portion of the surrounding wall 12, and a shaft-coupling member 15 extending through and disposed rotatably on the top plate 14. The surrounding wall 12 includes a pair of first and second housing members 121, 122 connected respectively and fixedly to two opposite side surfaces of the partition 13. The first housing member 121 cooperates with the partition 13 to define the first space 111. The second housing member 122 cooperates with the partition 13 to define the second space 112. The surrounding wall 12 is formed with two adjacent stop blocks 123 defining a first positioning groove 124 therebetween. The first positioning groove 124 has a rectangular cross section (see FIG. 6), and is in spatial communication with the second space 112. The top plate 14 has a top surface that is formed with a recess 141. The shaft-coupling member 15 extends through and is disposed rotatably on the top plate 14, and has a top end 151 disposed above the top plate 14, and a bottom end 152 disposed in the second space 112 and formed with a second positioning groove 153 having a rectangular cross section.

The driving mechanism 20 is received within the first space 111, and includes a motor 21 disposed within the recess 141 in the top plate 14, and a drive gear unit 22 driven by the motor 21 and disposed on the first housing member 121 and the partition 13. The motor 21 includes a spindle 211 and a driving gear 212 disposed fixedly on the spindle 211.

The drive gear unit 22 includes a driven gear 221 meshing with the driving gear 212, an output gear 222 driven indirectly by the driven gear 221, and a plurality of intermediate drive gears 223 interconnecting the driven gear 221 and the output gear 222. The output gear 222 rotates at a speed slower than that of the driven gear 221. In this embodiment, the driving gear 212 is configured as a worm, and the driven gear 221 is configured as a worm gear. As such, the driving gear 212 is in a self-locking condition. That is, the driven gear 221 can be rotated by the driving gear 212, but cannot rotate the driving gear 212.

The linkage 30 is received within the second space 112, and includes a swing rod 31 connected fixedly to the output gear 222 at one end 311 thereof, and a link 32 having a first end 321 connected pivotally to the other end 312 of the swing rod 31, and a second end 322 opposite to the first end 321.

The wheel unit 40 has a pivot end 411 connected pivotally to the housing unit 10, a wheel-mounting end 422 mounted with two wheels 44, and an intermediate portion connected pivotally to the second end 322 of the link 32.

In this embodiment, the wheel unit 40 includes a sleeve 41, a shaft member 42 disposed rotatably within the sleeve 41, and a plurality of bearings 43 disposed between the sleeve 41 and the shaft member 42 for facilitating rotation of the shaft member 42 within the sleeve 41. The sleeve 41 is configured with the pivot end 411, and a lug 412 connected pivotally to the second end 322 of the link 32. The first and second positioning grooves 124, 153 are spaced apart from the pivot end 411 by the same distance.

The shaft member 42 includes a shaft 421 disposed rotatably within the sleeve 41, and the wheel-mounting end 422 sleeved fixedly on the shaft 42. The shaft 421 is formed with an integral engaging member 423 that has a rectangular cross section and that is of a shape complementary to those of the first and second positioning grooves 124, 153.

Figure 7:
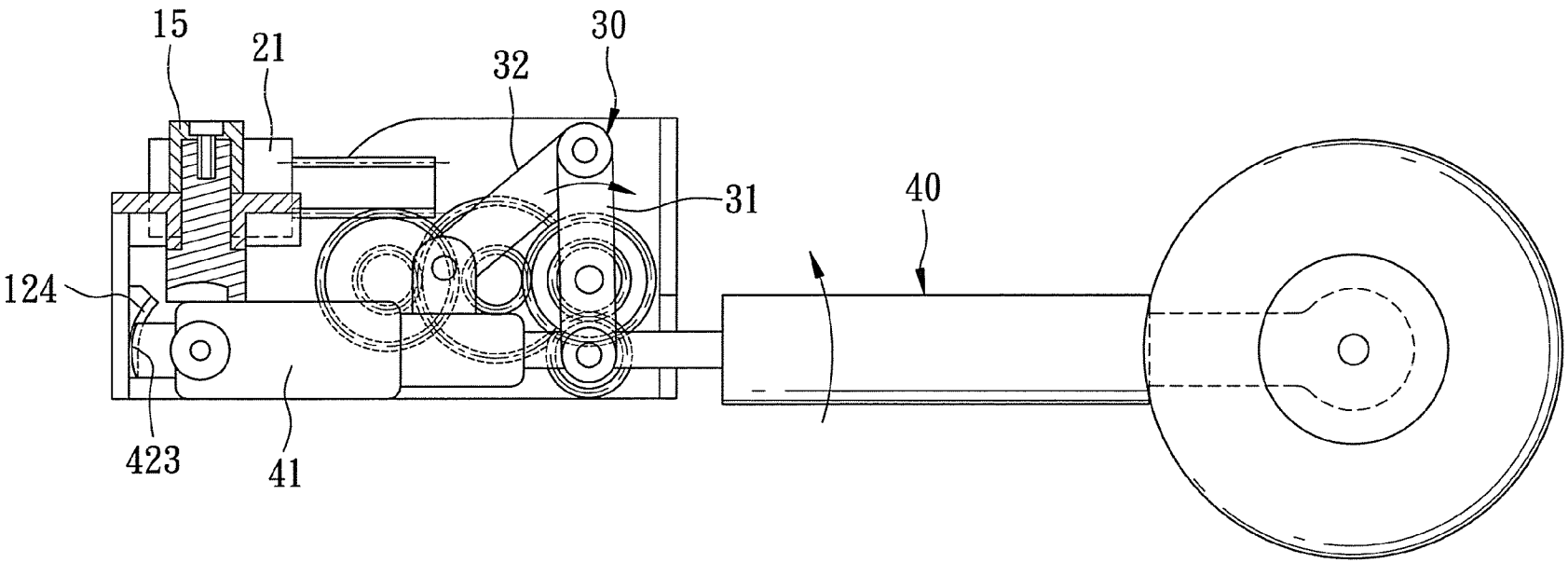
FIG. 7 is a side view of the preferred embodiment when the wheel unit is disposed in an idle position.
Figure 8:
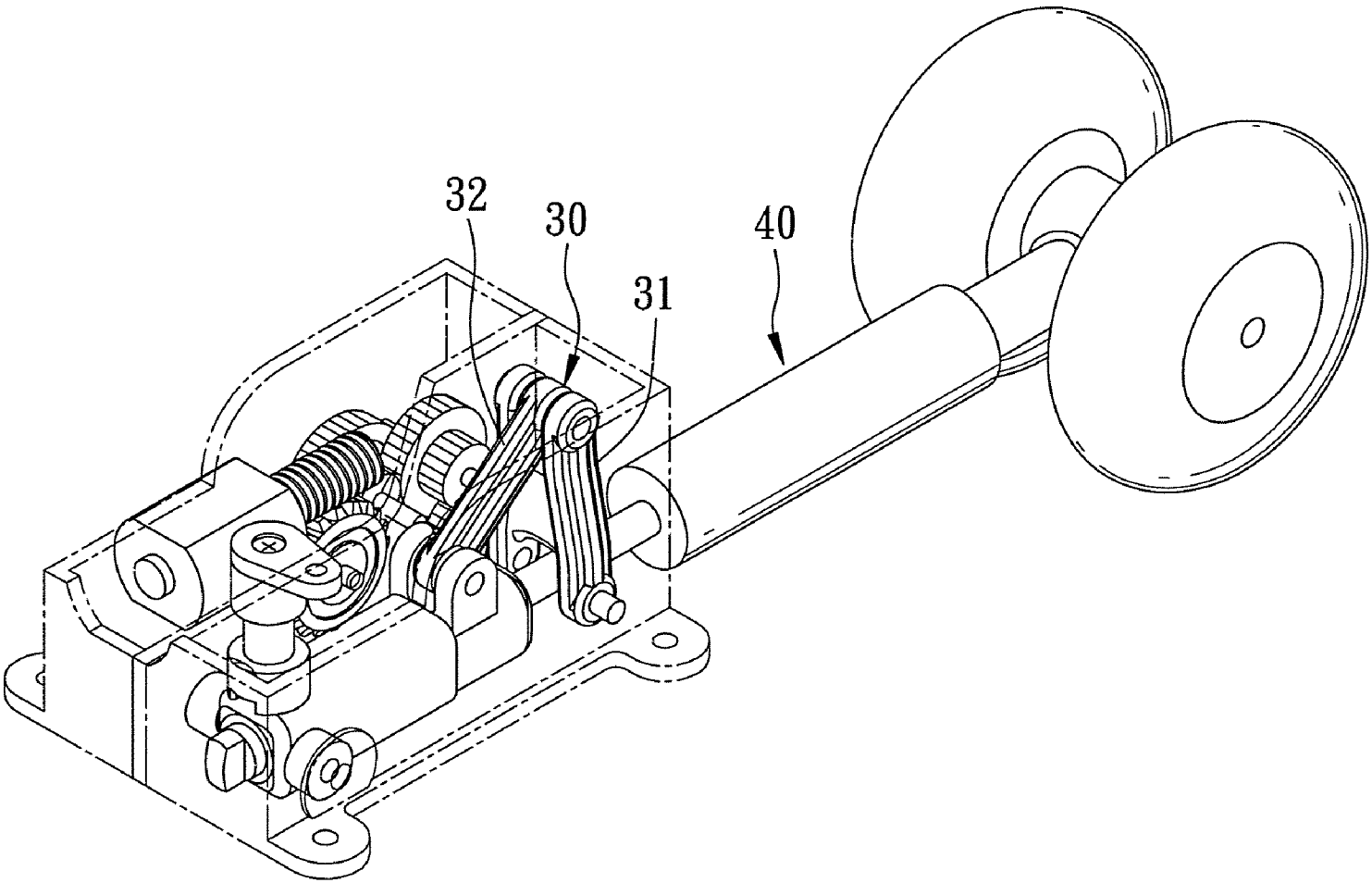
FIG. 8 is a perspective view of the preferred embodiment when the wheel unit is disposed in the idle position.
Figure 9:
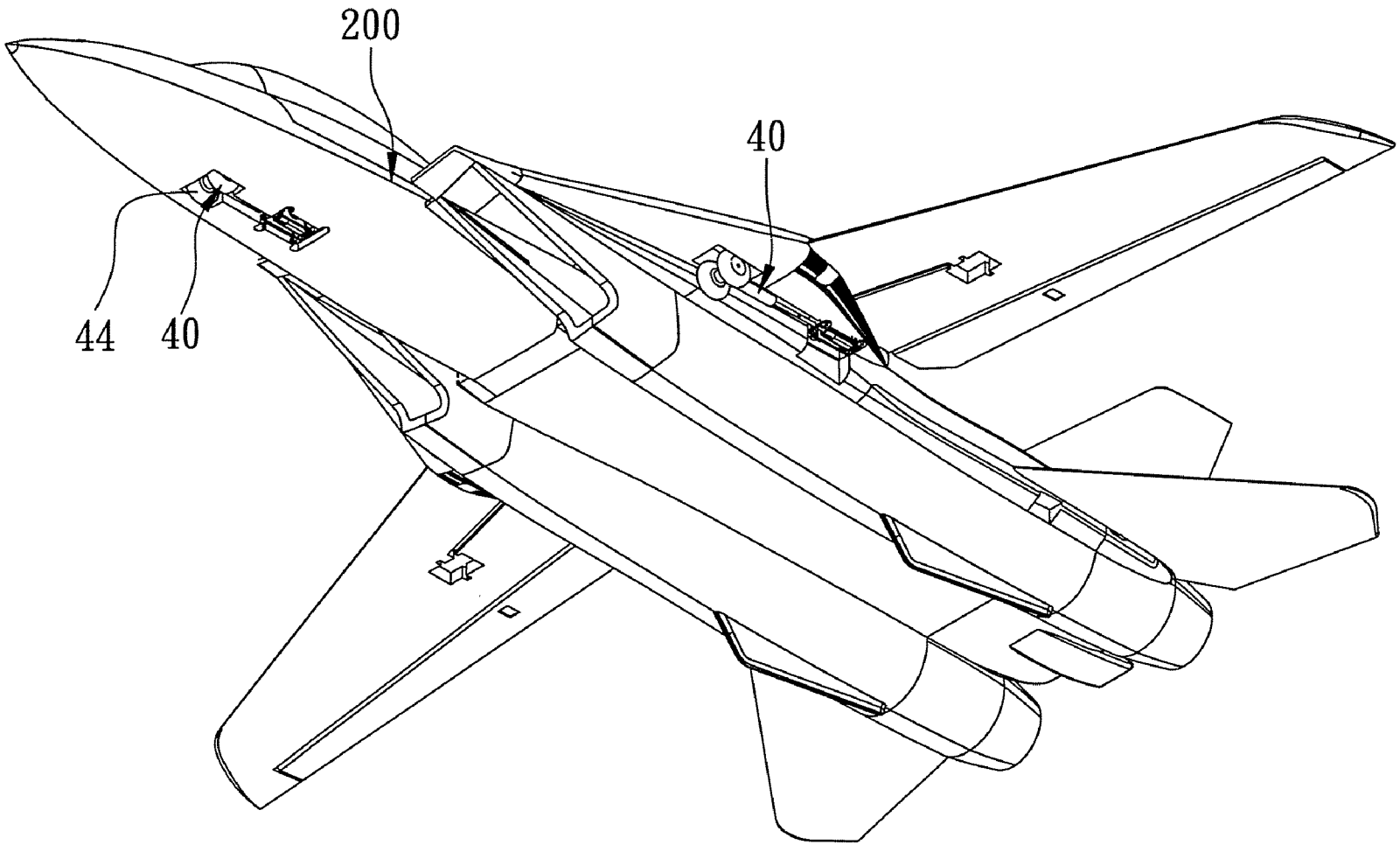
FIG. 9 is a view similar to FIG. 3, but when each of the wheel units is disposed in the idle position.
Figure 10:
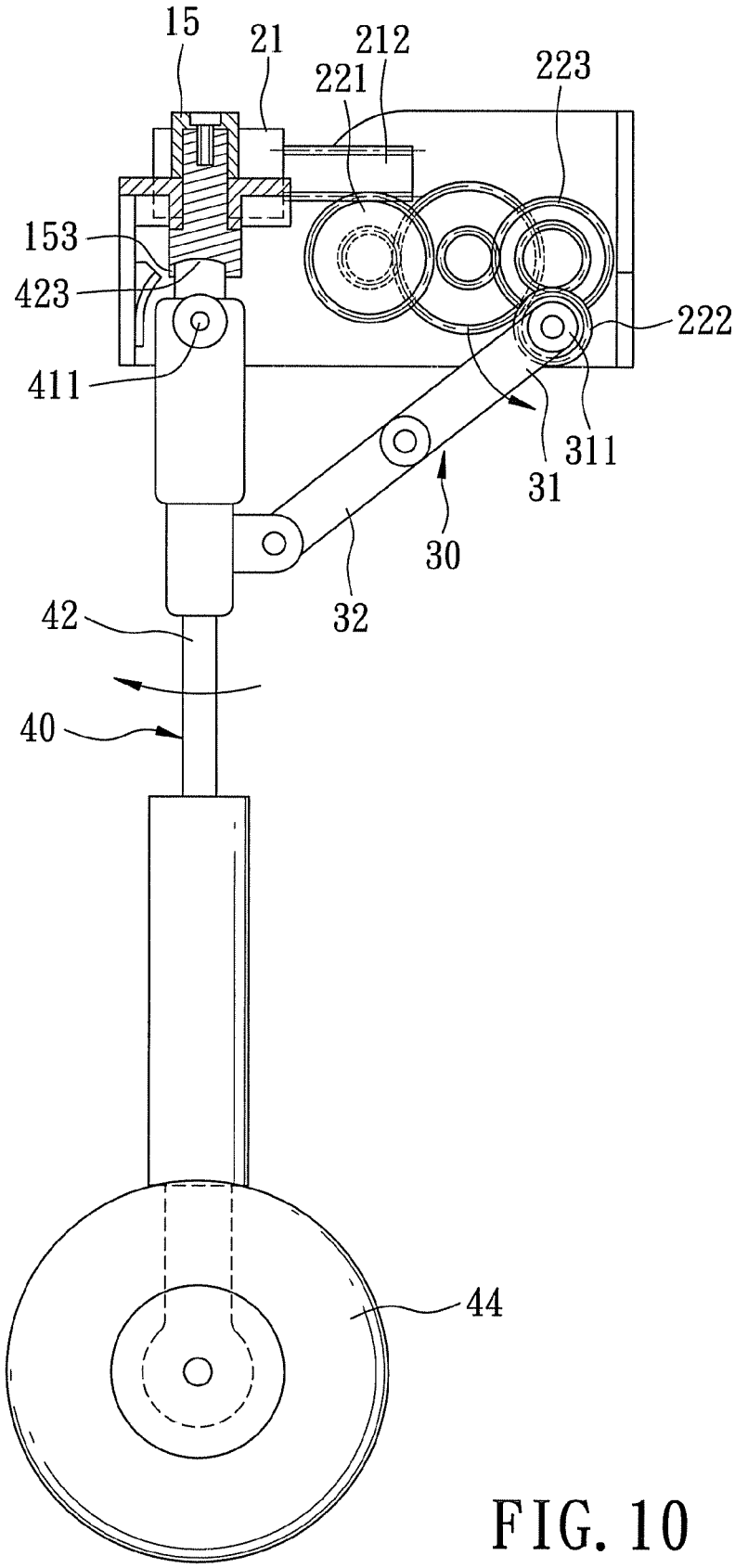
FIG. 10 is a schematic side view of the preferred embodiment when the wheel unit is disposed in the landing position.

As such, the motor 21 is operable to activate the drive gear unit 22 so as to rotate the wheel unit 40 about the pivot end 411 between a generally horizontal idle position shown in FIGS. 7, 8, and 9 and an upright landing position shown in FIGS. 5 and 10. In the idle position, portions of the wheels 44 are concealed within the airplane body 200, as shown in FIG. 9, and the swing rod 31 and the link 32 are positioned into a "V" shape. In the landing position, the wheels 44 are spaced apart from the airplane body 200, as shown in FIG. 3, and the swing rod 31 is aligned with the link 32.

After the wheel unit 40 is rotated from the landing position to the idle position in a counterclockwise direction, as shown in FIG. 7, so as to engage the engaging member 423 with the first positioning groove 124, the continued running of the motor 21 results in a quick increase in the load current of the motor 21 due indirectly to the inability of the wheel unit 40 to be further displaced in the same direction. In response to the quick increase in the load current of the motor 21, a controller (not shown) stops the motor 21. Thus, the wheel unit 40 is locked at the idle position.

Conversely, after the wheel unit 40 is rotated from the idle position to the landing position in a clockwise direction, as shown in FIG. 10, so as to engage the engaging member 423 with the second positioning groove 153, the continued running of the motor 21 similarly results in a quick increase in the load current of the motor 21. Hence, the controller stops the motor 21. Thus, the wheel unit 40 is locked at the landing position. In this state, due to engagement between the engaging member 423 and the second positioning groove 153, the shaft-coupling member 15 can be operated to perform a steering movement of the wheel unit 40.

In sum, the wheel assembly 100 of this invention has the following advantages:

(1) The wheel unit 40 can be locked at the idle position and the landing position by engagement of the engaging member 423 with the first and second positioning grooves 124, 153, respectively. This ensures flight safety, and increases the service life of the model airplane.

(2) Since the driving member 212 is self-locking, the wheel unit 40 can be maintained stably at the landing position and the idle position.

(3) The wheel unit 40 is rotated by the motor 21, the drive gear unit 22, and the linkage 30. Therefore, the rebounding problem of the abovementioned prior art is solved.

(4) The controller can be adjusted so as to change the rotational speed of the spindle 211 and, thus, the wheel unit 40.

With this invention thus explained, it is apparent that numerous modifications and variations can be made without departing from the scope and spirit of this invention. It is therefore intended that this invention be limited only as indicated by the appended claims.

I claim:

1. A wheel assembly for a model airplane, the model airplane having an airplane body, said wheel assembly being adapted to be mounted to the airplane body and comprising:

a driving mechanism including a motor and a drive gear unit driven by said motor, said motor including a spindle and a driving gear disposed fixedly on said spindle, said drive gear unit including a driven gear meshing with said driving gear, and an output gear driven indirectly by said driven gear;

a linkage including a swing rod connected fixedly to said output gear at one end thereof, and a link having a first end connected pivotally to the other end of said swing rod, and a second end opposite to the first end; and a wheel unit having a pivot end adapted to be connected pivotally to the airplane body, a wheel-mounting end opposite to said pivot end and said wheel-mounting end and connected pivotally to said second end of said link, wherein said wheel unit includes a sleeve, a shaft member disposed rotatably within said sleeve, and a plurality of bearings disposed between said sleeve and said shaft member for facilitating rotation of said shaft member within said sleeve, said sleeve being configured with said pivot end and a lug connected pivotally to said second end of said link, said shaft member being configured with said wheel-mounting end;

wherein said motor is operable to activate said drive gear unit so as to rotate said wheel unit between a generally horizontal idle position, where at least a portion of said wheel is concealed within the airplane body, and an upright landing position, where said wheel is spaced apart from the airplane body.

2. The wheel assembly as claimed in claim 1, wherein said driving gear is configured as a worm, said driven gear being configured as a worm gear, said drive gear unit further including a plurality of intermediate drive gears interconnecting said driven gear and said output gear such that said output gear rotates at a speed slower than that of said driven gear.

3. The wheel assembly as claimed in claim 1, further comprising a housing unit including:

a surrounding wall adapted to be connected fixedly to the airplane body and defining an accommodating chamber, said surrounding wall being formed with a first positioning groove; and a partition disposed within said accommodating chamber so as to divide said accommodating chamber into a first space for receiving said drive gear unit, and a second space for receiving said linkage, said first positioning groove being in spatial communication with said second space;

a top plate connected fixedly to a top portion of said surrounding wall; and a shaft-coupling member extending through and disposed rotatably on said top plate and having a bottom end that is disposed in said second space and that is formed with a second positioning groove;

said shaft member being formed with an integral engaging member that has a rectangular cross section and that is of a shape complementary to those of said first and second positioning grooves, said engaging member engaging said first positioning groove in said surrounding wall when said wheel unit is disposed in said idle position, said engaging member engaging said second positioning groove in said shaft-coupling member when said wheel unit is disposed in said landing position.

* * * * *